United States Patent [19]

Elfgen

[11] Patent Number: 4,729,603

[45] Date of Patent: Mar. 8, 1988

[54] ROUND CUTTING TOOL FOR CUTTERS

[76] Inventor: Gerd Elfgen, Theissenkreuzweg 10, D-5303 Bornheim 3, Fed. Rep. of Germany

[21] Appl. No.: 896,216

[22] Filed: Aug. 14, 1986

Related U.S. Application Data

[63] Continuation-in-part of Ser. No. 799,966, Nov. 20, 1985, abandoned.

[30] Foreign Application Priority Data

Nov. 22, 1984 [DE] Fed. Rep. of Germany ..... 3442546

[51] Int. Cl.[4] ..... F21B 10/00

[52] U.S. Cl. ..... 299/93; 175/410

[58] Field of Search ..... 175/410, 414; 125/40, 125/21; 408/144; 299/91, 93

[56] References Cited

U.S. PATENT DOCUMENTS

| | | | |
|---|---|---|---|
| 465,748 | 12/1891 | Baumotte | 125/40 |
| 973,887 | 10/1910 | Steinmetz | 175/414 |
| 1,685,196 | 9/1928 | Gilbert | 299/91 |
| 3,140,749 | 7/1964 | Dionisotti | 175/410 |
| 3,268,259 | 8/1966 | Snipe | 299/91 |
| 3,356,418 | 12/1967 | Healey | 299/91 |
| 3,361,481 | 1/1968 | Meddock | 299/91 |
| 3,388,757 | 6/1968 | Fittinger | 175/410 |
| 3,493,268 | 2/1970 | Bower | 175/410 |
| 3,884,212 | 5/1975 | Armstrong | 125/21 |
| 4,065,185 | 12/1977 | Elders | 299/91 |
| 4,159,746 | 7/1979 | Wrulich | 175/410 |

FOREIGN PATENT DOCUMENTS

| | | | |
|---|---|---|---|
| 751991 | 7/1980 | U.S.S.R. | 299/91 |

*Primary Examiner*—Harold D. Whitehead

*Attorney, Agent, or Firm*—Diller, Ramik & Wight

[57] ABSTRACT

A cutter including a chisel wheel having an axis of rotation about which the wheel is adapted to rotate during a cutting operation; a plurality of cutting tools each including a tool body having a longitudinal axis, a chisel bit and a chisel shank; the chisel wheel carrying chisel holders which freely rotatably mount each cutting tool for rotation about its associated axis, each chisel bit being a separate hard metal body fixed to an end portion of its associated tool body remote from its associated shank, each chisel bit having a cone shaped working section merging toward an apex portion, a plurality of peripherally spaced axially extending grooves formed in the cone-shaped working section which automatically rotate each cutting tool about its longitudinal axis during the operation of the chisel wheel, and each longitudinal axis setting-off with a plane normal to the axis of rotation of the chisel and included angle of up to generally 45° which ensures uniform wear of each chisel bit, particularly its apex portion, during operation of the chisel wheel.

6 Claims, 7 Drawing Figures

ROUND CUTTING TOOL FOR CUTTERS

CROSS-REFERENCE TO RELATED APPLICATION

This application is a continuation-in-part application of U.S. application Ser. No. 06/799,966 filed Nov. 20, 1985 in the name of Gerd Elfgen and now abandoned.

BACKGROUND OF THE INVENTION

The invention relates to a round cutting tool for cutters comprising a metallic basic body having a chisel shank, and a chisel bit consisting of a hard metal body fixed to the front end of the basic body and having a substantially cone-shaped working section.

Round cutting tools are used, e.g., for crushing and removing rock in mining and to remove worn road surfaces. The rotating chisel wheel of a cutter is provided with a number of chisel holders to rotatably support therein the shanks of the round cutting tools. As the chisel wheel is rotated, the individual round cutting tools successively engage the material to be removed which is frequently very hard and/or tough. As a result, the round cutting tools are exposed to high dynamic stresses and the chisel bits suffer form strong wear.

The chisel bit of a round cutting tool consists of a hard metal body whose working section forms a cone being round at the point and having a taper angle between about 30° to 90°. It is the object of the cone of the hard metal body to cut and break open the material to be removed. With increasing wear, the taper angles become greater and greater, i.e., the cone size is reduced to a round head. As a consequence thereof, the cutting action of the chisel bit will become insufficient and finally ineffective. With an increasing wear of the round cutting tool, the energy consumption for the rotation of the chisel wheel will be higher and higher. During the service life of the round cutting tool, the required energy frequently is three to four times higher than at the beginning because the chisel bits do not grip any longer correctly, the material to be removed being rather displaced than cut open and crushed.

The higher the forces acting on the chisel, the higher the stress to which the chisel shanks and holders are exposed. Since the chisels are operating in a strongly contaminated environment, the penetration of dirt into the region between the chisel shaft and the bore of the chisel holder entails a high wear if the attacking forces are correspondingly intense.

SUMMARY OF THE INVENTION

A round cutting chisel is fixed to the chisel wheel of the cutter so that it extends at an angel between 5° and 45° relative to a plane normal to the axis of rotation of the chisel wheel. Due to said angle, the chisel bit, when engaging the surface to be removed, rolls off the latter so that the chisel is rotated about its longitudinal axis. In view of a uniform wear, said rotation is rather important. The stronger the wear of the conical working section, the weaker the rotation, in particular if the turning resistance of the basic body in the chisel holder has increased due to dirt, seizure of material and wear. In practice, after some time, the round cutting tools are completely blocked against rotation so that they are used unilaterally and the resultant wear is high.

It is another disadvantage of the known round cutting chisels that, in case of a strongly worn bit of the hard metal body, the removed material can not flow away, but it rather moves against the rearward region of the hard metal body or the basic body to create lateral cavities, which finally may result in the fact that the chisel bit is completely hollowed out to finally break down.

It is the object of the invention to design a cutting tool of the above mentioned type so that the cutting effect is maintained over a long period, while the energy consumption of the driving machine is reduced and the service lives of the round cutting tool, as well as of the fixing means used for its support, are increased.

The problem is solved according to the invention in that the conical surface of the hard metal body contains peripherally distributed recesses.

Due to the recesses in the hard metal body the grip property of the chisel bit is increased, whereby the rotational behavior of the round cutting tool is improved. The removed material may escape through the recesses to be laterally displaced by the chisel. The formation of lateral undercuts at the basic body is avoided. Due to the contoured outer surface of the hard metal body, the surface to be removed is engaged more effectively, and by the self-sharpening effect, the sharpness of the chisel is maintained for a longer time thus reducing energy consumption of the driving machines.

According to a preferred embodiment of the invention, the recesses are grooves extending axially, and through which the material set free is carried away rearwardly. Further, the wear of the outer surface of the hard metal body is nearly the same as that of its bit, thus ensuring that the pointed shape of the working section is maintained also after a longer service life and that material is effectively removed also in case of wear, as specified above. The energy consumption of the driving machines is low and substantially constant.

Due to the longitudinally extending grooves, the turning behavior of the round cutting chisel is maintained together with the uniform wear over the periphery of the chisel bit.

Preferably, at least one end of the grooves decreases in depth and they pass over into the conical surface. With such a groove shape, the discharge of the material is favored which s carried off laterally via the front end of the basic body.

The recesses of the hard metal body need not be necessarily empty, but they may be filled with a material which is softer than that of the hard metal body. If such a round cutting chisel is used, the softer material in the recesses is worn off more strongly than the material of the hard metal body. On the other hand, the softer material forms a support for the wall portions of the hard metal body between the recesses. By this means, the external surface portion of the hard metal body occupied by the recesses may be made relative large without running the risk of wall breaks. The material filling the recesses may consist of solid metal parts soldered into the recesses. By a suitable selection of the softer material in connection with a respective shape of the recesses, one may realize a uniform wear of the outer surface in the working section of the hard metal body which, consequently may substantially maintain its shape. the recesses being at the lateral wall while the central region including the bit consists of a massive hard metal, the outer regions, in case of wear, yield to the same extent as the inner regions.

In case of a pin chisel in which the hard metal body contains a cylindrical section adjacent to the working section, the recesses are also provided preferably in the cylindrical section. The groove-shaped recessed of the working section may extend as far as into the cylindrical section. Thus, a "synchronous wear" of hard metal body and basic body may be obtained with such a pin chisel. In other words, in case of a chisel which became useless by wear, not only the hard metal body but also the basic body are worn to the same extent.

The invention offers a further advantage by the saving of material concerning the relatively expensive hard metal. Due to the recesses provided in the hard metal body, the latter contains much less hard metal in spite of a substantially improved efficiency and a constant behaviour in wear and operation.

The invention will be explained hereinunder in more detail with reference to the enclosed drawings showing some embodiments thereof.

BRIEF DESCRIPTION OF THE DRAWINGS

Figure 1:
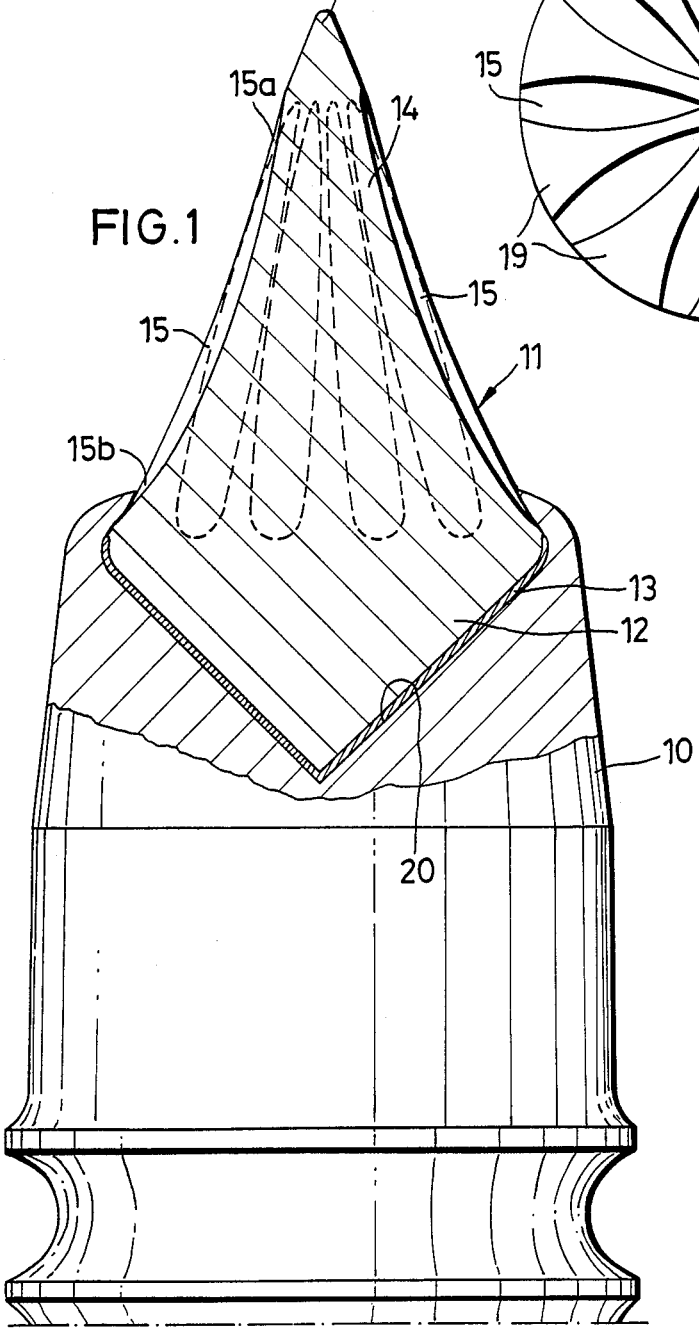
FIG. 1 is a side view, partly broken away, of the portion of a round cutting tool designed as a cone chisel.
Figure 2:
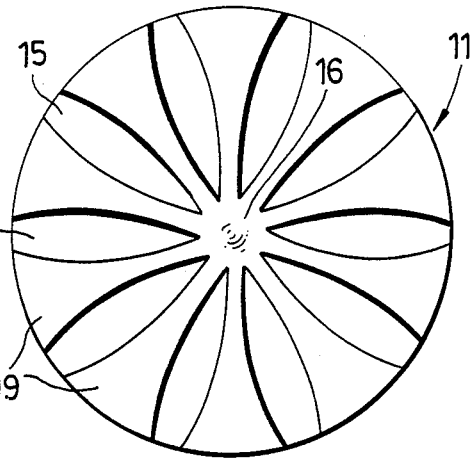
FIG. 2 is a plan view of the hard metal body of FIG. 1.

The round cutting tool 5 according to FIGS. 1, 5 through 7 consists of a basic body 10 of an axially symmetric design and of a hard metal body 11 fixed by soldering in a recess at the front end of the basic body 10, the hard metal body 11 being shaped as a double cone and the lower cone 12 being fixed with soldering material 13 in the correspondingly adapted cone-shaped recess 20 of the basic body 10. The upper cone 14 of the hard metal body 11 has a greater length with a resultant smaller taper angle than the lower cone 12, and it forms the working portion of the hard metal body projecting from the basic body 10. Along the cone face of the upper cone 14 extend grooves 15 ending at a distance from the bit 16, and the depth of each groove 15 decreasing towards the upper end 15a and towards the lower end **15*b*, thus ensuring that the ends of said grooves continuously pass over into the cone face. In the illustrated embodiment, the grooves 15** are empty.

Figure 5:
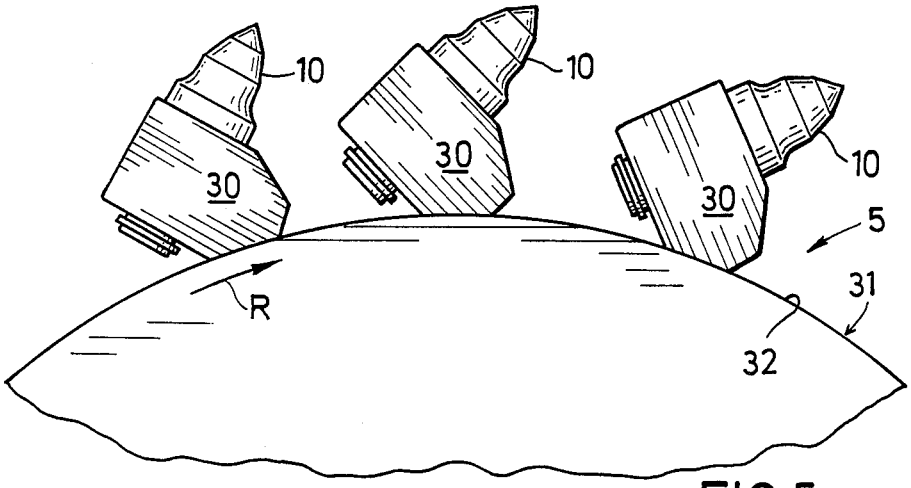
FIG. 5 is fragmentary side elevational view of the cutting tool, and illustrates a plurality of chisel holders and associated chisels carried upon a periphery of a rotatable drum of the tool.
Figure 6:
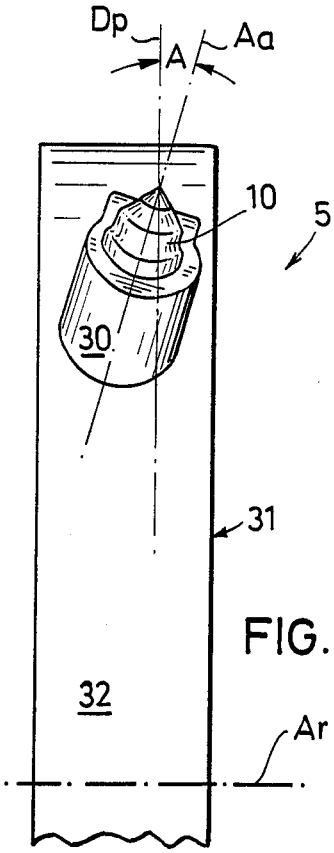
FIG. 6 is a fragmentary schematic view of the cutting tool, and illustrates the angular relationship of each chisel to the plane of the drum and the axis of rotation thereof.
Figure 7:
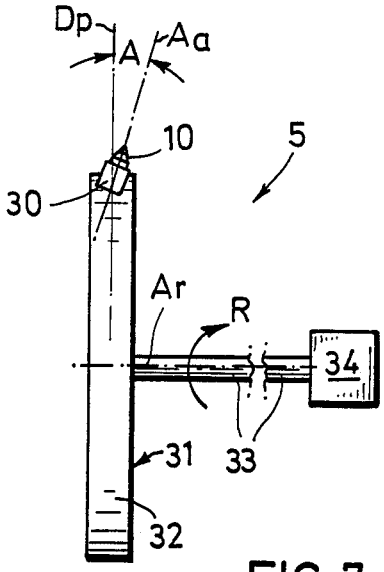
FIG. 7 is a fragmentary top plan view of the drum, and illustrates one of the chisel holders, its chisel, and the angular relationship thereof to a plane through the drum normal to the axis of rotation of the drum.

In case of use of the round cutting tool 5, a chisel shank **10*a* situated at the basic body 10 end opposite from the hard metal body 11 is inserted into a bearing bore of a chisel holder 30 (FIGS. 5 through 7). The chisel 10 is held at an acute angle A relative to the surface to be removed, travels there-along, with the bit 16 continuously cutting into the surface to be removed. As is best illustrated in FIGS. 5 through 7, the angle A is measured between the longitudinal or central axis Aa of each chisel bit 10 (FIGS. 6 and 7) and a plane Dp through a rotatable drum, cylinder or a member 31 having a peripheral surface 32 to which each of the chisel holders 30 is attached. The plane Dp of the drum 31 is normal to an axis of rotation Ar of a shaft 33 which is rotated by suitable drive means 34, such as a hydraulic, pneumatic or electric motor with the rotation being designated by the reference numeral R in FIGS. 5 and 6. The angle A is preferably between 5° and 45° relative to the plane Dp which is, as noted earlier, normal to the axis of rotation Ar of the shaft 33. Thus, as the shaft 33 rotates clockwise in FIGS. 5 and 6, each bit 10, when engaging the surface to be removed, is caused to be rotated about its axis Aa by reaction forces between the bits 10 and the material/ground being engaged/-removed. This rotation of each chisel bit 10 constantly places different surface areas in opposition to the material being removed during the rotation of the chisel wheel or drum 31 thereby achieving uniform wear of each chisel bit. Due to the grooves 15 weakening the outer surface, the pointed shape of the hard metal body 11** is maintained upon its wear. Further, the grooves increase the grip property of the round cutting tool which may rotate about its longitudinal axis even against a high turning resistance and in case of a worn hard metal body.

Figure 3:
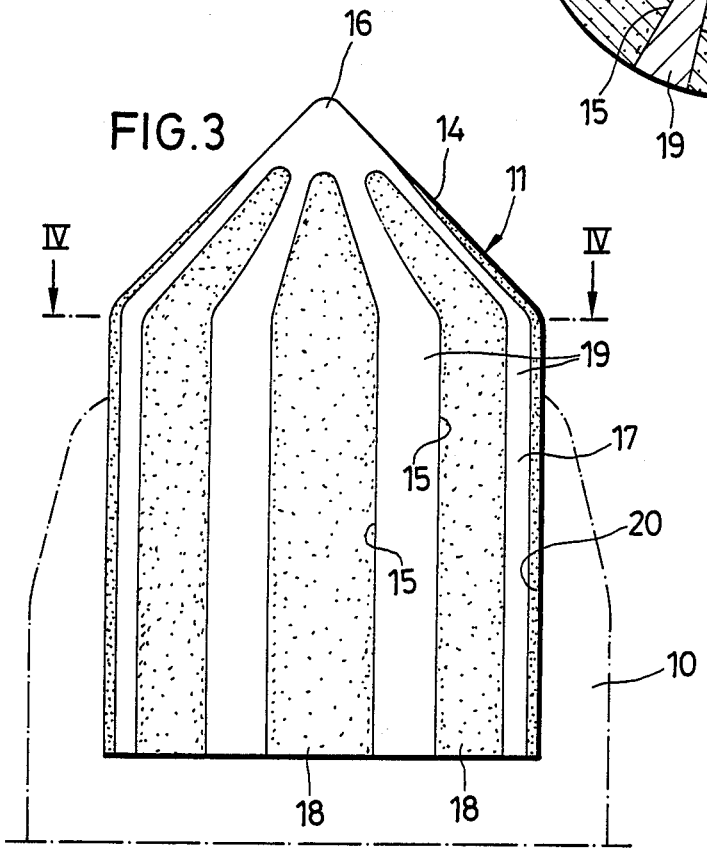
FIG. 3 is a side view of the hard metal body of a round cutting tool designed as a pin chisel.
Figure 4:
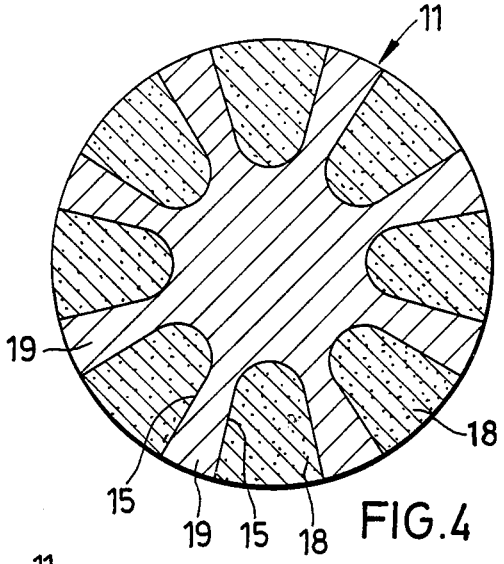
FIG. 4 is a section along line IV—IV of FIG. 3.

FIGS. 3 and 4 show a round cutting tool of the pin chisel type. The cone-shaped working section 14 of the hard-metal body 11 is joined by a cylindrical section 17 fitted into a cylindrical recess 20 of the basic body 10 to be fixed there by soldering. The grooves 15 extend from the vicinity of the bit 16 of the hard metal body as far as to the opposite end or to shortly in advance thereof. In this embodiment, the grooves 15 are filled with rods of a material softer than that of the hard metal body, the shape and dimension of the rods being adapted to the grooves 15, which may be completely filled by them. The radial stems 19 keeping the grooves 15 mutually spaced, may be of a relatively narrow design, because, in being held laterally by the soldered rods 18, they are also protected against breaking. As is obvious from FIG. 4, the width of each stem 19 is flared radially to the outside. At the outer surface of the hard metal body, said stems 19 form rectangular sharp edges.

While, in the first embodiment, the grooves 15 extend substantially in parallel to the cone-shaped outer surface of the working section 14, the bottoms of the grooves 15 of the second embodiment extend in parallel to each other and relative to the longitudinal axis of the hard metal body, over the total length of the grooves, which, in the cylindrical portion 17, are deeper than in the cone-shaped working region 14 in which the depth continuously decreases.

If the round cutting tool of FIGS. 3 and 4 is in use, the working region 14 is worn off first of all, while the upper end of the hard metal body 11 still maintains its conical shape. The more said cone is displaced downwardly, the more is the basic body 10 material removed that surrounds the recess 20. In other words, a synchronous wear between the hard metal body 11 and the basic body 10 is achieved.

Although in a preferred embodiment of the invention as has been specifically illustrated and described herein, it is to be understood that minor variations may be made in the apparatus without departing from the spirit and scope of the invention, as defined in the appended claims.

I claim:

1. A round cutting tool for cutters comprising a metallic basic body defined by a chisel shank, said chisel shank carrying a separate chisel bit, said chisel bit being a hard metal body defined by a cylindrical body portion merging with a frusto-conical working portion which in turn merges with a terminal cone-shaped body portion; a plurality of longitudinally extending peripherally spaced recesses formed in said cylindrical body portion along generally the entire length thereof which continue into said frusto-conical body portion and terminate at said cone-shaped body portion without entering the latter; and said recesses being filled with material which is softer than the metal of said chisel bit body.

2. The round cutting tool as defined in claim 1 wherein the depth of the material in each of said recesses decreases convergingly in a direction toward said cone-shaped body portion and remains generally constant in each of said recesses along said cylindrical body portion.

3. The round cutting tool as defined in claim 1 wherein the depth of the material in each of said recesses decreases convergingly in a direction toward said cone-shaped body portion and remains generally constant in each of said recesses along said cylindrical body portion, and solder means for retaining said material in said recesses.

4. A round cutting tool for cutters comprising a metallic basic body defined by a chisel shank, said chisel shank carrying a separate chisel bit, said chisel bit being a hard metal body defined by a first cone-shaped mounting body portion having an apex directed in a first direction toward and received in a similarly contoured recess of said chisel shank and an opposite second cone-shaped body portion having a terminal apex directed in a second direction opposite to said first direction, a generally frusto-conical working body portion between said first and second cone-shaped body portions, a plurality of longitudinally extending peripherally spaced recesses formed in said frusto-conical working body portion and having opposite ends terminating at respective ones of each of said cone-shaped body portions without entering the latter and the apices thereof, each said recesses converging in said second direction, and said recesses being filled with material which is softer than the metal of said chisel bit body.

5. The round cutting tool as defined in claim 4 wherein the depth of the material in each of said recesses decreases convergingly in both of said first and second directions.

6. The round cutting tool as defined in claim 4 wherein the depth of the material in each of said recesses decreases convergingly in both of said first and second directions, and solder means for retaining said cone-shaped mounting body portion in said chisel shank recess.

* * * * *